US009512578B1

(12) United States Patent
Dvoracek et al.

(10) Patent No.: US 9,512,578 B1
(45) Date of Patent: Dec. 6, 2016

(54) TRAFFIC CONE

(71) Applicants: Joe Dvoracek, Burbank, CA (US); Rick Durapau, Austin, TX (US)

(72) Inventors: Joe Dvoracek, Burbank, CA (US); Rick Durapau, Austin, TX (US)

(73) Assignee: Three D Plastics, Inc., Burbank, CA (US)

( * ) Notice: Subject to any disclaimer, the term of this patent is extended or adjusted under 35 U.S.C. 154(b) by 0 days.

(21) Appl. No.: 14/574,012

(22) Filed: Dec. 17, 2014

(51) Int. Cl.
*E01F 9/012* (2006.01)

(52) U.S. Cl.
CPC ..... *E01F 9/0122* (2013.01); *E01F 9/688* (2016.02)

(58) Field of Classification Search
CPC ..... E01F 9/012; E01F 9/0122; E01F 9/60; E01F 9/688; E01F 9/692
USPC ..... 116/63 C, 63 P; 404/9
See application file for complete search history.

(56) References Cited

U.S. PATENT DOCUMENTS

| | | | | | |
|---|---|---|---|---|---|
| 3,147,734 | A * | 9/1964 | Knapp | ..... | 116/63 R |
| 3,451,368 | A * | 6/1969 | Keats | ..... | 116/63 R |
| 3,880,406 | A * | 4/1975 | Stehle | ..... | E01F 13/02 116/63 P |
| 4,492,728 | A * | 1/1985 | Zurkinden | ..... | E01C 13/065 428/323 |
| 4,925,334 | A * | 5/1990 | Beard | ..... | 404/9 |
| 5,421,668 | A * | 6/1995 | Cowan et al. | ..... | 404/6 |
| 5,566,638 | A * | 10/1996 | Rokosny | ..... | 116/63 C |
| D474,987 | S | 5/2003 | Dvoracek | | |
| D475,315 | S | 6/2003 | Dvoracek | | |
| D490,334 | S | 5/2004 | Dvoracek | | |
| 6,817,805 | B2 * | 11/2004 | Mettler et al. | ..... | 404/6 |
| 7,513,212 | B2 | 4/2009 | Dvoracek | | |
| 7,520,694 | B2 | 4/2009 | Dvoracek | | |
| 2005/0008433 | A1 | 1/2005 | Dvoracek | | |
| 2012/0234228 | A1 * | 9/2012 | Kuo | ..... | 116/63 C |
| 2015/0299967 | A1 * | 10/2015 | Maus | ..... | E01F 9/0122 116/63 C |

FOREIGN PATENT DOCUMENTS

| | | | | | |
|---|---|---|---|---|---|
| EP | 0594899 | A1 * | 5/1994 | ..... | E01F 9/012 |
| GB | 981074 | A * | 1/1965 | ..... | E01F 9/012 |
| GB | 992281 | A * | 5/1965 | ..... | E01F 9/012 |
| GB | 1058881 | A * | 2/1967 | ..... | E01F 9/012 |
| GB | 2144789 | A * | 3/1985 | ..... | E01F 9/0122 |
| GB | 2211529 | A * | 7/1989 | ..... | E01F 9/00 |
| GB | 2212194 | A * | 7/1989 | ..... | E01F 15/00 |
| TW | 200936847 | A * | 2/2008 | ..... | E01F 9/012 |

* cited by examiner

*Primary Examiner* — R. A. Smith
(74) *Attorney, Agent, or Firm* — Patent Law & Venture Group; Gene Scott

(57) ABSTRACT

A molded funnel shaped cone joined with a base molded of compress crumb rubber has a pair of peripheral, outside flanges spaced apart and in contact with upper and lower surfaces of the base. The body has a pair of opposing apertures adjacent to the top end for placement of a barrier marking tape and for other uses.

8 Claims, 4 Drawing Sheets

TRAFFIC CONE

BACKGROUND

This disclosure relates primarily to the universally well-known traffic cone which is used for controlling pedestrian and vehicular traffic. Cones; also referred to as traffic pylons, road cones, highway cones, safety cones, and construction cones, are generally upright hollow shells which are placed on roads or footpaths to temporarily redirect or control traffic. They may actually be cone shaped or polygonal in cross-section and are often used to create separation or merge lanes during road construction projects or automobile accidents. Heavier, more permanent markers or signs are used if a diversion is to stay in place for more than a few hours or days. Cones are typically used outdoors during road work or other situations requiring traffic redirection or advance warning of hazards or dangers, or the prevention of traffic ingress. Cones are also used to mark where children may play or to block off an area to foot traffic. For night time use or low-light situations cones are usually fitted with a retro-reflective sleeves or patches to increase their visibility. On occasion, cones may also be fitted with flashing lights for the same reason. In the United States, cones are required by the Federal Highway Administration to be fitted with reflective white bands for night-time visibility. Reflective collars such as white strips made from white reflective plastic, may slip over cones snugly, and tape or adhesive can be used to attach the collars to the cones permanently. Cones are designed to be highly visible and easily movable. Various sizes are used, commonly ranging from around 30 cm (11.8 in) to a little over 1 m (39.4 in). Cones come in many different colors, with orange, yellow, pink, and orange being the most common due to their brightness. Others may be green or blue, and may also have a retro-reflective strip attached, commonly known as "flash tape," to increase their visibility. There are several difficulties with the cones now in use. One problem is that there is no easy way to tie cones together to form a continuous "do not cross" visible barrier strip. Therefore, cones are typically placed in a tight line to form a barrier. This is wasteful since fewer cones might be used if it were simple to string a barrier tape between cones that are spaced wider apart. Another problem is that cones must be light in weight and yet weighed-down to remain stationary under windy conditions and when grazed by vehicles or tampered with by children. Prior art cones accomplish this by using a ring of a heavy material which is dropped over the cone. Upon contact with a vehicle the cone and ring tend to separate. Another approach is the use of fasteners to join the ring and cone. This requires expensive assembly time and fastener costs. A still further approach is to mold both cone and ring integrally. This presents a molding problem since the cone and the ring require different cooling times and the cost of cone material is high relative to what a wing can be made of. Co-molding the ring and cone has been used but has problems in proper joining of the two separate parts and is relatively expensive in terms of molding set-up time. The presently described cone and ring approach overcomes the drawbacks of the prior art presenting a superior solution which is cost efficient in manufacture and also handles well in use, providing advantages which are described in the following.

BRIEF DESCRIPTION OF DRAWINGS

Like reference symbols in the drawing figures indicate like elements.

DETAILED DESCRIPTION

Embodiments shown in FIGS. 1 through 4 illustrate concepts of a vehicular and pedestrian traffic control device, cone 10, according to this written disclosure and the above described accompanying drawing figures. Embodiments comprise a combination assembly which is made-up of two separate parts: a one piece base 20, and a body 30 which may be manufactured separately by different processes, and which may then be joined together to acquire a distinctive commercial and utilitarian use. It is clear that body 30 may be configured in the shape of a cone or funnel as shown in the figures or may have other shapes such as cylindrical round or cylindrical square, etc. However, the term "cone" is used in this document to represent traffic control elements of any shape.

Figure 1:
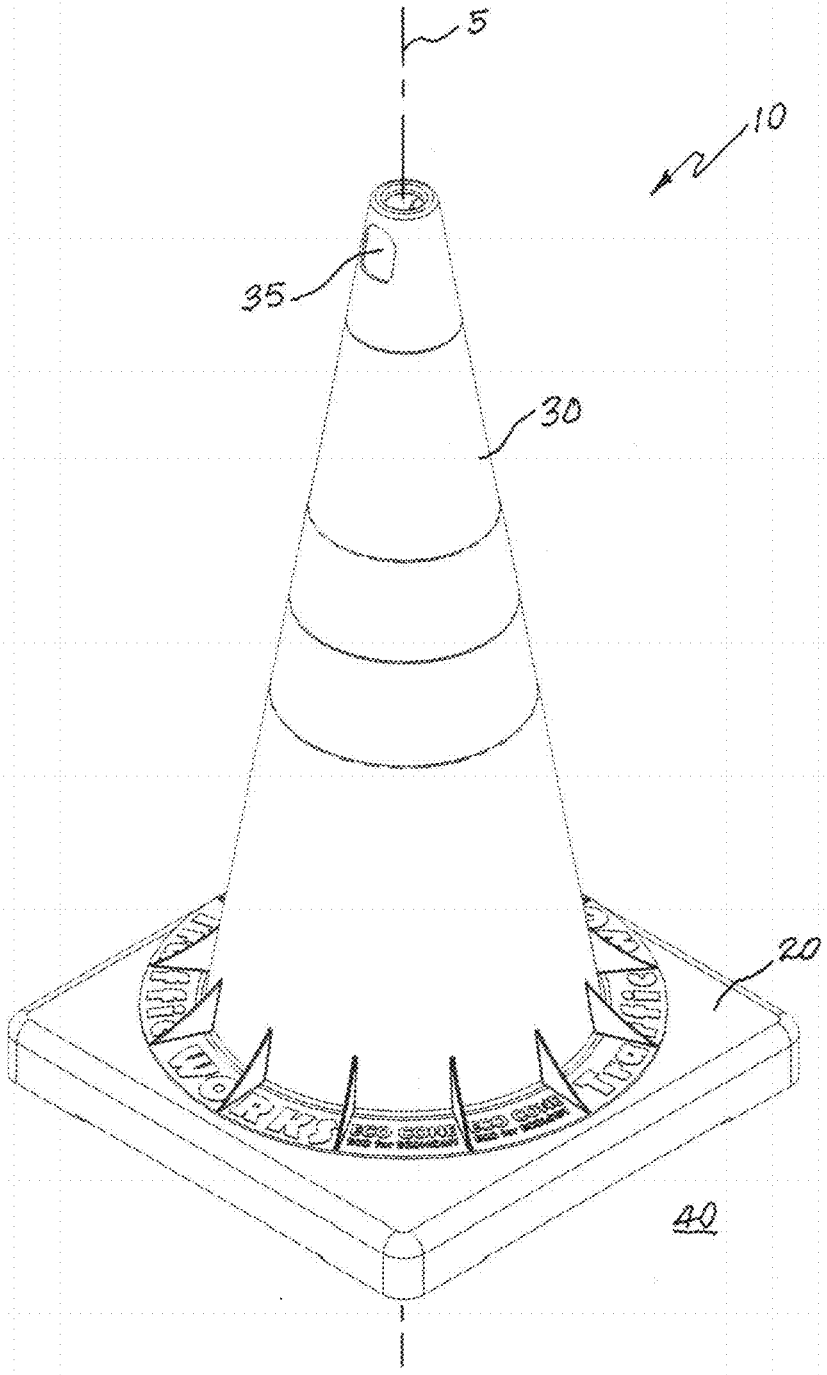
FIG. 1 is a perspective view of an embodiment of a cone according to the concepts described herein.

Cone 10 is used for controlling traffic, both pedestrian and vehicular, and for marking-off areas that are not open to ingress, or alternately marking areas that are safe for entry or use. As shown in FIG. 1 cone 10 may be placed on any supporting surface 40 such as an earthen, grassy or paved surface or other surfaces of choice, both indoors and out-of-doors. Cone 10 is often used in retail stores to mark off aisles not in use or to prevent walking near spills for instance. Cone 10 is also used to mark temporary vehicular traffic lanes on roads and highways. By definition, cone 10 is positioned with its central axis 5 oriented vertically, i.e., extending upwardly from surface 40. In this disclosure we refer to elements of cone 10 as either upward, that is away from surface 40, or downward, that is, toward surface 40.

Figure 2:
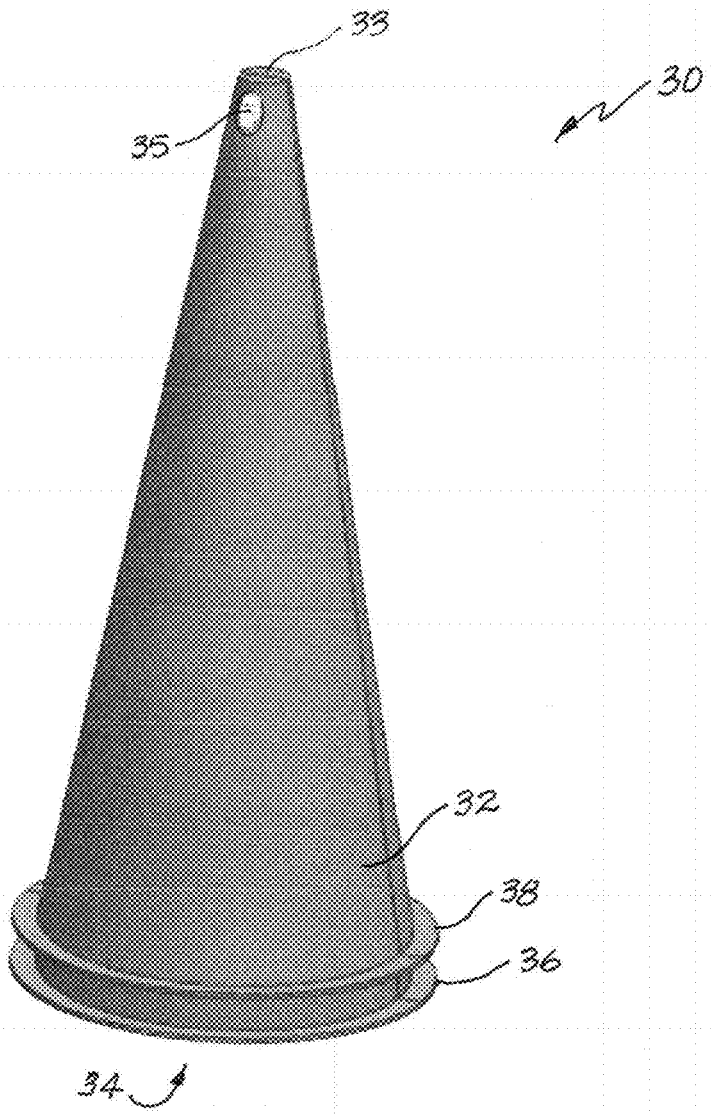
FIG. 2 is a perspective view of a body of a further embodiment thereof.
Figure 4:
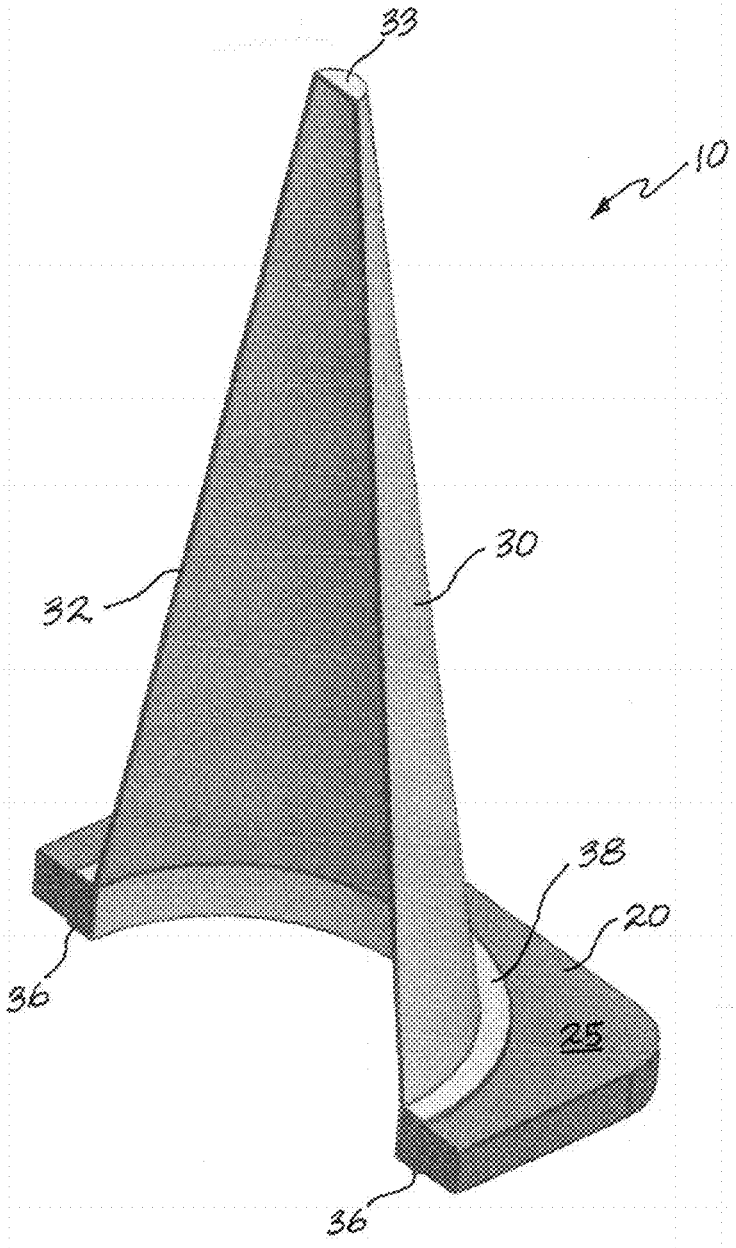
FIG. 4 is a perspective vertical cross-section view of FIGS. 2 and 3 as joined.

Body 30, as shown in FIG. 2, may have a molded side wall 32 which may be cone shaped and preferably between 12 and 40 inches in height wherein a cone height of less than 12 inches often is overlooked defeating its usefulness, and a height of greater than 40 inches becomes cumbersome to move, may limit visibility, and may be subject to upset by wind. As shown, body 30 may have a relatively small diameter top end 33 and may have a larger bottom end 34, terminating with a pair of integral annular, circular, outside flanges; a lower flange 36 and an upper flange 38 which are spaced axially apart as shown in FIGS. 2 and 4. Side wall 32 and flanges 36 and 38 may have a wall thickness not greater than 175 mils (175 mils=0.175 inches), while lower flange 36 may extend outwardly from side wall 32 by between 1 and 2.5 inches and upper flange 38 may extend outwardly from side wall 32 by from one-half to 2.5 inches. It has been found by trial and error testing that these dimensions provide excellent strength, durability, and functional operation in mounting base 20. As shown by FIG. 4, body 30 must have enough flexibility and resilience to collapse in order to mount base 20 between flanges 36 and 38 and thereafter resume its smooth walled shape afterwood. This has been accomplished by the use of specific molding materials for producing a highly flexible and resilient body 30 as described here.

Flanges 36 and/or 38 may be angled so they extend outwardly from side wall 32 in mutual convergence and preferably at an inclusive angle of between 3 and 7 degrees. By this means, flanges 36 and 38 tend to clamp base 20 between them as shown in FIG. 4. It has been found by trial and error that this angular range is critical to the operating performance of cone 10 given the materials of construction and dimensions defined above. Side wall 32 may be other than cone shaped, but the cone is the most common shape in use worldwide and allows easy nesting of multiple cones 10. Body 30 may be made of a combination of ethyl vinyl acetate (EVA) plus polyethylene or other polymers and polymer combinations. This material has been found through trial and error to be able to sustain crushing and thereafter resume its original shape through the resilience of these materials. The combination of EVA/PE has shown excellent physical characteristics of rebound-ability, static strength and durability and has been found by extensive trial and error that the material combination is critical to superior operating performance of cone 10.

Figure 3:
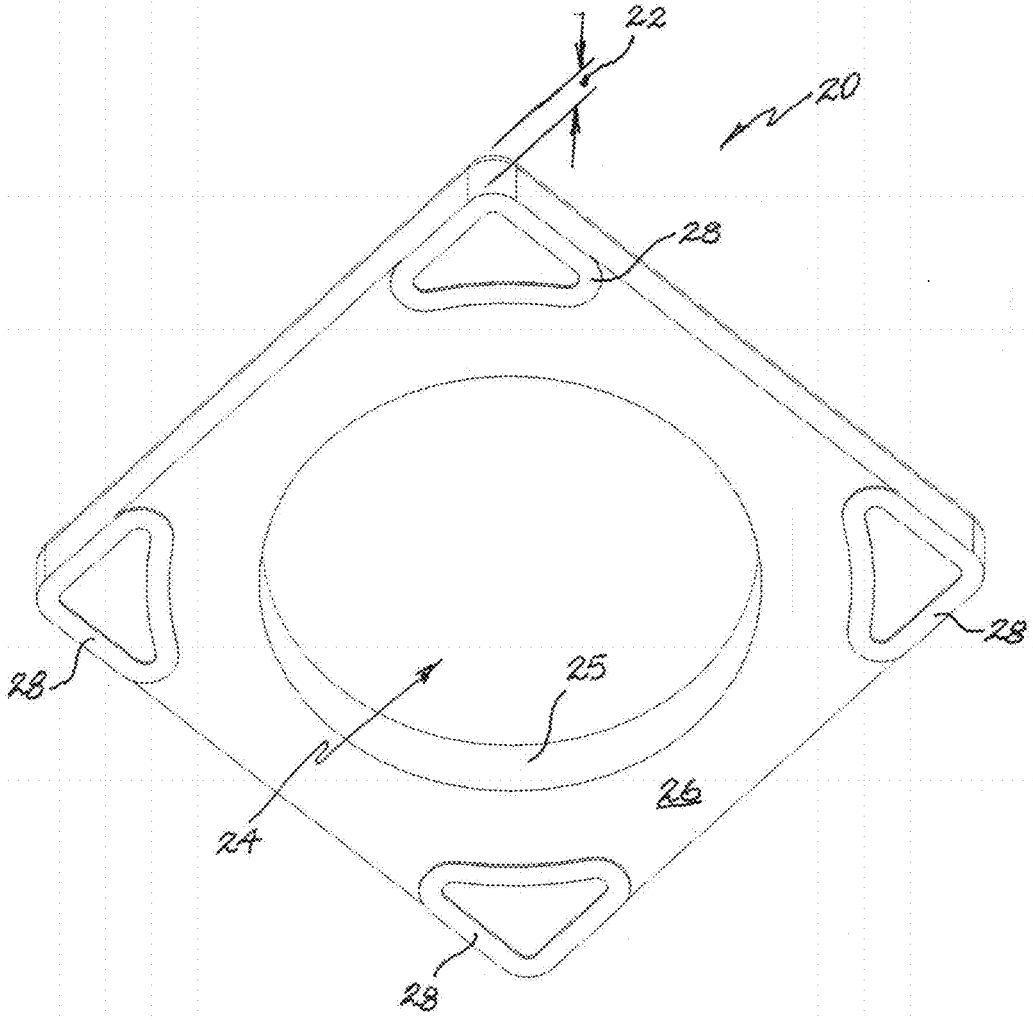
FIG. 3 is a perspective bottom view of a base thereof.

It is estimated that 259 million vehicular tires are discarded yearly in the United States. Base 20 may be molded by compressing shredded vehicle tires ("crumb rubber") under high heat (350 degrees F.) and pressure (1200 to 1600 psi) to produce a desired product with a useful shape and density as shown in FIG. 3. A polyurethane glue binder may be used to assure complete integration of all of the small pieces of the crumb rubber that comprise base 20 although some of the crumb rubber pieces may be as small as dust particles. Once molded, base 20 is a wholly integrated part and in the cone application may have a square or rectangular footprint as shown and may have a central aperture or penetration 24 for engaging with body 30. Base 20 may alternately have a circular or polygonal shape and a thickness 22 of between 1 and 4 inches which must be sufficient to provide enough weight to prevent cone 10 from tilting over in winds up to 60 miles per hour. Base 20, if square as shown may be between 11 and 15 inches on a side for a cone 10 between 18 and 28 inches tall. Such a base 20 must secure body 30 so that it doesn't move with wind or other forces. Base 20 may have standoffs or feet 28 so as to elevate its bottom surface 26 above supporting surface 40. This provides the advantage of allowing minor runoff water to pass under base 20 instead carrying it along.

Side wall 32 of body 30 may be smoothly and continuously tapered between top end 33 and bottom end 34 as shown in FIG. 2. In embodiments, aperture 24 of base 20 may have a tapered side wall 25 to fit tightly against tapered side wall 32 in the space between flanges 36 and 38. In embodiments, base aperture 24 and side wall 32 may both have a constant, non-tapered, diameter in the space between flanges 36 and 38 as shown in FIG. 4. Both of these approaches have been found to be acceptable in use as long as side wall 32 is in full contact with aperture side wall 25 between flanges 36 and 38. Such full contact inhibits base 20 separation from body 30.

In embodiments, body 30 may have a pair of opposing apertures 35 adjacent to top end 33 whereby a barrier marking tape (not shown) of any well-known type may be inserted through apertures 35 so as to tie two or more of cones 10 together to thereby mark a boundary of a no-entry zone, a danger zone, a crime scene, and so on. Apertures 35 may be of a size for receiving one or two fingers of a hand so that cone 10 may be more easily manually handled especially in nesting cones 10.

In use, body 30 is placed into aperture 24 of base 20 and the conical shape of sidewall 32 is compressed in order to fit base 20 between flanges 36 and 38. Once this is accomplished, sidewall 32 is released and it resumes its original shape without help. This occurs because of the resilient material of construction of side wall 32, and its thickness. These characteristics of body 30 in combination enable this operation and are considered to be a novel and non-obvious combination that results in said capability and capacity. Upon being struck or run-over by a vehicle, cone 10 recovers from being squashed. Flanges 36 and 38 are sized to maintain capture of base 20 through a run-over event while still enabling removal and replacement of base 20. This combination of characteristics and capabilities have been discovered by rigorous testing while varying shapes, sizes, materials, and other parameters.

Body 30, may be compressed to place it within base 20 while having a resilience, that is, a restoration elasticity wherein after said compression a desired smooth shape of said body 30 is restored. Likewise, with body 30 positioned within base 20 as shown in FIGS. 1 and 4, removal of base 20 from body 30 requires compression of body 30 after which body 30 resumes its intended and desired shape once more by its own resilience.

Base 20 is molded of crumb rubber because of its relatively high weight density and low manufacturing cost which is mainly due to the cost of shredded tire material. The size of base 20 is calculated to enable anchoring of cone 10 sufficiently to withstand typical wind forces and contact with passing vehicles. This combination of characteristics and capabilities have been discovered by rigorous trials.

Body 30 may be injection molded in order to achieve consistent wall thickness and integrated flanges including specific angular mutual positioning of flanges 36 and 38 which enables a clamping force on base 20, and also achieves placement of a pair of opposing apertures 35 adjacent a top end 33 of said body 30 for placement of a barrier marking tape or a crime scene tape so as to tie an arrangement of cones into a crowd controlling mechanism.

Embodiments of the subject apparatus and method have been described herein. Nevertheless, it will be understood that modifications by those of skill in the art may be made without departing from the spirit and understanding of this disclosure. Accordingly, other embodiments and approaches are within the scope of the following claims.

What is claimed is:

1. A traffic cone comprising:

a cone-shaped body having an annular side wall;

a pair of spaced apart annular flanges extending outwardly from said annular side wall;

a one-piece base having a planar top surface and a generally planar bottom surface and a through hole extensive therebetween;

said cone-shaped body engaged within said through hole with said one-piece base positioned between said spaced apart annular flanges; and wherein, said annular flanges are radially convergent thereby exerting a compressive force on said base.

2. The traffic cone of claim 1 wherein said cone-shaped body is characterized as having a flexibility enabling deformation for engagement with said one-piece base and further characterized as having a shape restoration elasticity wherein after said engagement of said one-piece base, the shape of said cone-shaped body is restored.

3. The traffic cone of claim 1 wherein said cone-shaped body is characterized as having a flexibility enabling deformation from an original shape for disengagement from said one-piece base and a shape restoration elasticity enabling restoration of said cone-shaped body to said original shape.

4. The traffic cone of claim 1 wherein said one-piece base has sufficient weight for maintaining said cone in a vertical orientation against wind forces of up to approximately 60 miles per hour.

5. The traffic cone of claim 1 wherein said side wall is made of a combination material of ethyl vinyl acetate plus at least one of polyethylene and polypropylene.

6. The traffic cone of claim 1 wherein said through hole has a sidewall conforming to said annular side wall of said cone-shaped body.

7. The traffic cone of claim 6 wherein said through hole has a vertical sidewall.

8. The traffic cone of claim 6 wherein said through hole has a conical sidewall.

* * * * *